US008674803B2

(12) United States Patent
Stanek et al.

(10) Patent No.: US 8,674,803 B2
(45) **Date of Patent: *Mar. 18, 2014**

(54) MODERATELY HAZARDOUS ENVIRONMENT FUSE

(75) Inventors: Daniel Stanek, Lincolnshire, IL (US); Daniel Gilman, Chicago, IL (US); Nathan Siegwald, Tolono, IL (US); William G. Rodseth, Antioch, IL (US)

(73) Assignee: Littelfuse, Inc., Chicago, IL (US)

( * ) Notice: Subject to any disclaimer, the term of this patent is extended or adjusted under 35 U.S.C. 154(b) by 130 days.

This patent is subject to a terminal disclaimer.

(21) Appl. No.: 12/605,803

(22) Filed: Oct. 26, 2009

(65) Prior Publication Data

US 2010/0102920 A1 Apr. 29, 2010

Related U.S. Application Data

(63) Continuation-in-part of application No. 11/837,911, filed on Aug. 13, 2007, now Pat. No. 7,808,362.

(51) Int. Cl.
*H01H 85/30* (2006.01)
*H01H 85/165* (2006.01)

(52) U.S. Cl.
USPC ..... 337/187; 337/186; 337/206; 337/242

(58) Field of Classification Search
USPC ..... 337/186, 187, 251, 206, 242, 191; 439/176, 382–385, 799, 800, 890
See application file for complete search history.

(56) References Cited

U.S. PATENT DOCUMENTS

| | | | | | |
|---|---|---|---|---|---|
| 1,435,651 | A | * | 11/1922 | Murray, Jr. et al. | 337/260 |
| 1,562,984 | A | * | 11/1925 | Murray | 337/237 |
| 1,751,439 | A | * | 3/1930 | Brown | 337/260 |
| 2,167,608 | A | * | 7/1939 | Cole et al. | 439/803 |
| 2,625,626 | A | * | 1/1953 | Matthysse | 337/159 |
| 2,713,098 | A | * | 7/1955 | Swain | 337/161 |
| 3,037,266 | A | * | 6/1962 | Pfister | 29/613 |
| 3,041,427 | A | * | 6/1962 | Waller et al. | 337/243 |
| 3,118,035 | A | * | 1/1964 | Lebens | 337/209 |
| 3,213,345 | A | * | 10/1965 | Loftus | 320/122 |
| 3,522,570 | A | * | 8/1970 | Wanaselja | 337/28 |
| 3,655,926 | A | | 4/1972 | Meermans | |
| 3,681,731 | A | | 8/1972 | Kozacka | |
| 3,801,945 | A | | 4/1974 | Howard | |
| 3,848,215 | A | | 11/1974 | Kozacka et al. | |
| 3,863,191 | A | | 1/1975 | Salzer | |
| 3,866,318 | A | | 2/1975 | Kozacka | |
| 3,870,984 | A | | 3/1975 | Salzer | |
| 3,871,296 | A | | 3/1975 | Heilprin et al. | |
| 3,878,423 | A | | 4/1975 | Hill et al. | |
| 3,909,767 | A | | 9/1975 | Willaimson et al. | |
| 3,914,863 | A | | 10/1975 | Wiebe | |
| 3,962,668 | A | | 6/1976 | Knapp, Jr. | |
| 3,969,694 | A | | 7/1976 | Kozacka | |

(Continued)

FOREIGN PATENT DOCUMENTS

JP 03254033 A * 11/1991 ..... H01H 37/76

*Primary Examiner* — Anatoly Vortman
(74) *Attorney, Agent, or Firm* — Kacvinsky Daisak PLLC

(57) ABSTRACT

A fuse for a moderately hazardous environment comprising: (i) a fuse element; (ii) first and second terminals connected to the fuse element; and (iii) a metal enclosure placed around the fuse element, the enclosure configured to protect the environment from an opening of the fuse element, and wherein the first and second terminals extend from the metal enclosure.

18 Claims, 5 Drawing Sheets

(56) References Cited

U.S. PATENT DOCUMENTS

| | | | | | |
|---|---|---|---|---|---|
| 4,008,451 | A | | 2/1977 | Salzer | |
| 4,023,264 | A | | 5/1977 | Schmidt, Jr. et al. | |
| 4,032,265 | A | | 6/1977 | Miller | |
| 4,041,435 | A | * | 8/1977 | Gaia | 337/159 |
| 4,041,525 | A | | 8/1977 | Kozacka | |
| 4,053,861 | A | | 10/1977 | Knapp, Jr. | |
| 4,065,849 | A | | 1/1978 | Kozacka | |
| 4,067,103 | A | | 1/1978 | Ciesmier | |
| 4,074,785 | A | | 2/1978 | Masevice | |
| 4,099,320 | A | | 7/1978 | Schmidt, Jr. et al. | |
| 4,099,321 | A | | 7/1978 | Aryamane | |
| 4,099,322 | A | | 7/1978 | Tait | |
| 4,108,266 | A | | 8/1978 | Wojtyna | |
| 4,131,869 | A | | 12/1978 | Schmidt, Jr. et al. | |
| 4,150,354 | A | | 4/1979 | Namitokov et al. | |
| 4,166,267 | A | | 8/1979 | Belcher et al. | |
| 4,198,617 | A | | 4/1980 | Hara | |
| 4,203,200 | A | | 5/1980 | Wiebe | |
| 4,210,892 | A | | 7/1980 | Salzer | |
| 4,224,592 | A | | 9/1980 | Urani et al. | |
| 4,233,482 | A | | 11/1980 | DiMarco et al. | |
| 4,240,122 | A | | 12/1980 | Smith | |
| 4,245,208 | A | | 1/1981 | Belcher | |
| 4,254,394 | A | | 3/1981 | Kozacka et al. | |
| 4,267,543 | A | | 5/1981 | Arikawa | |
| 4,281,309 | A | * | 7/1981 | Olson | 337/409 |
| 4,290,183 | A | | 9/1981 | Tait | |
| 4,306,212 | A | | 12/1981 | Belcher | |
| 4,329,006 | A | | 5/1982 | Gale | |
| 4,374,371 | A | | 2/1983 | Narancic | |
| 4,386,335 | A | | 5/1983 | O'Brien et al. | |
| 4,394,638 | A | | 7/1983 | Sian | |
| 4,409,582 | A | | 10/1983 | Kimmel et al. | |
| 4,414,526 | A | | 11/1983 | Panaro | |
| 4,417,225 | A | | 11/1983 | Muller et al. | |
| 4,434,548 | A | | 3/1984 | Beswick | |
| 4,463,398 | A | | 7/1984 | Boozer et al. | |
| 4,463,399 | A | | 7/1984 | Matherly et al. | |
| 4,551,354 | A | | 11/1985 | Feder | |
| 4,552,091 | A | | 11/1985 | Feder | |
| 4,553,188 | A | | 11/1985 | Aubrey et al. | |
| 4,560,971 | A | | 12/1985 | Oh | |
| 4,580,124 | A | | 4/1986 | Borzoni | |
| 4,604,601 | A | | 8/1986 | O'Brien | |
| 4,612,858 | A | | 9/1986 | Backstein et al. | |
| 4,630,022 | A | | 12/1986 | Yuza | |
| 4,641,120 | A | * | 2/1987 | Bonfig et al. | 337/242 |
| 4,646,053 | A | | 2/1987 | Mosesian | |
| 4,661,793 | A | | 4/1987 | Borzoni | |
| 4,712,081 | A | | 12/1987 | Bosley | |
| 4,727,348 | A | | 2/1988 | Okazaki | |
| 4,757,423 | A | | 7/1988 | Franklin | |
| 4,760,367 | A | | 7/1988 | Williams | |
| 4,801,278 | A | | 1/1989 | Sappington | |
| 4,860,151 | A | | 8/1989 | Hutcheon et al. | |
| 4,890,186 | A | | 12/1989 | Matsubara et al. | |
| 4,962,363 | A | | 10/1990 | Sexton, Jr. | |
| 4,972,170 | A | | 11/1990 | Ehlmann et al. | |
| 4,991,674 | A | | 2/1991 | Fullenkamp | |
| 4,998,086 | A | | 3/1991 | Kourinsky et al. | |
| 5,055,817 | A | | 10/1991 | O'Shields et al. | |
| 5,130,688 | A | | 7/1992 | Van Rietschoten et al. | |
| 5,168,434 | A | | 12/1992 | Kobayashi | |
| 5,293,951 | A | | 3/1994 | Scott | |
| 5,297,645 | A | | 3/1994 | Eckersley et al. | |
| 5,365,395 | A | | 11/1994 | Callaway | |
| 5,437,939 | A | | 8/1995 | Beckley | |
| 5,441,123 | A | | 8/1995 | Beckley | |
| 5,451,173 | A | | 9/1995 | Mai | |
| 5,520,258 | A | | 5/1996 | Kemshall | |
| 5,561,409 | A | | 10/1996 | Rapp et al. | |
| 5,611,424 | A | | 3/1997 | Sniezek et al. | |
| 5,643,012 | A | | 7/1997 | Mai et al. | |
| 5,643,693 | A | | 7/1997 | Hill et al. | |
| 5,645,448 | A | | 7/1997 | Hill | |
| 5,680,089 | A | | 10/1997 | Matsuoka | |
| 5,709,280 | A | | 1/1998 | Beckley et al. | |
| 5,745,023 | A | | 4/1998 | Totsuka | |
| 5,841,337 | A | | 11/1998 | Douglass | |
| 5,854,583 | A | | 12/1998 | Falchetti | |
| 5,889,458 | A | | 3/1999 | Nakamura | |
| 5,900,798 | A | | 5/1999 | Hanazaki et al. | |
| 6,064,293 | A | * | 5/2000 | Jungst et al. | 337/290 |
| 6,067,004 | A | * | 5/2000 | Hibayashi et al. | 337/227 |
| 6,222,438 | B1 | * | 4/2001 | Horibe et al. | 337/290 |
| 6,275,135 | B1 | | 8/2001 | Hibayashi et al. | |
| 6,275,136 | B1 | | 8/2001 | Yamaguchi | |
| 6,294,978 | B1 | * | 9/2001 | Endo et al. | 337/166 |
| 6,411,498 | B2 | | 6/2002 | Nakamura | |
| 6,430,017 | B1 | | 8/2002 | Finlay, Sr. et al. | |
| 6,448,882 | B1 | * | 9/2002 | Inaba et al. | 337/227 |
| 6,486,766 | B1 | * | 11/2002 | Reid et al. | 337/186 |
| 6,494,279 | B1 | | 12/2002 | Hutchens | |
| 6,552,646 | B1 | * | 4/2003 | Wong | 337/252 |
| 6,556,122 | B2 | | 4/2003 | Izaki et al. | |
| 6,700,768 | B2 | | 3/2004 | Werni | |
| 6,724,292 | B2 | * | 4/2004 | Miyashita et al. | 337/290 |
| 6,762,670 | B1 | * | 7/2004 | Yen | 337/203 |
| 6,778,061 | B2 | | 8/2004 | Nakano et al. | |
| 6,948,982 | B2 | | 9/2005 | Higuchi et al. | |
| 7,042,327 | B2 | * | 5/2006 | Tanaka et al. | 337/290 |
| 7,172,462 | B1 | | 2/2007 | Gronowicz, Jr. | |
| 7,173,510 | B2 | * | 2/2007 | Kono et al. | 337/159 |
| 7,323,966 | B2 | | 1/2008 | Yoshikawa | |
| 7,327,213 | B2 | * | 2/2008 | Martin et al. | 337/199 |
| 7,369,030 | B2 | * | 5/2008 | Darr | 337/243 |
| 7,460,004 | B1 | * | 12/2008 | Yang | 337/206 |

* cited by examiner

MODERATELY HAZARDOUS ENVIRONMENT FUSE

This application is a continuation-in-part of U.S. patent application Ser. No. 11/837,911, filed Aug. 13, 2007, which is expressly incorporated by reference herein in its entirety.

BACKGROUND

The present disclosure relates generally to circuit protection and more particularly to fuse protection for moderately hazardous environments.

Forklift trucks ("forklifts") have been used either to lift goods of relatively heavy weight up to an elevated location or to lower the goods to the ground. Forklifts also can be used to move the goods from one place to another within a limited working area. Depending on the power sources employed, the forklifts are classified into an engine-driven forklift, which may operate in an outdoor area and an electromotive forklift, which is suitable for indoor operation, due to its reduced emission of exhaust gas and noise.

In either case, forklifts may operate in a potentially hazardous environment, such as a potentially flammable or explosive environment. Accordingly, fuses for forklifts need to be maintained such that an opening of the fuse element, which can cause a spark, does not cause an explosion or start a fire. Fuses for forklifts and similar vehicles are therefore required to be located inside a metal casing according to Underwriters Laboratories ("UL") standard 583. Enclosing all of the forklift fuses in the same enclosure is space consuming, relatively expensive and makes servicing the fuses difficult.

Accordingly, an improved fuse for a moderately hazardous environment is needed.

SUMMARY

The present disclosure provides a fuse for a moderately hazardous environment, which is classified under UL 583 as EE and ES. The fuse includes terminals that extend from a protective enclosure, which makes servicing the fuses easier than with prior fuses for moderately hazardous environment conditions, which were fully enclosed.

The fuse in one embodiment includes a fuse element. First and second terminals extend from or are connected to the fuse element. A metal enclosure is placed around the fuse element. The enclosure is sized and configured to protect the environment from an opening of the fuse element. The first and second terminals extend from the metal enclosure.

In one embodiment, the enclosure includes first and second end caps connected to a metal body of the enclosure. The first and second terminals extend through the first and second end caps, e.g., through slits in the end caps, respectively. The end caps can be plastic, e.g., a high temperature thermoset plastic or thermoform plastic or other suitable insulator, such as ceramic or rubber. The metal body of the enclosure can be aluminum, steel or stainless steel, for example.

The first and second end caps are attached mechanically to the metal body of the enclosure, for example, staked to the enclosure via the first and second terminals. For example, the terminals can have one or stamped stake or bump that fastens the terminals to the end caps. Alternatively or additionally, the insulating end caps are adhered to the metal body. The end caps can each have an outer portion that mates flush with an outer surface of the metal portion of the enclosure and an inner portion that fits snugly inside the metal portion.

The enclosure can have different cross-sectional shapes, such as an at least substantially rectangular or square shape, an at least substantially elliptical shape or an at least substantially round shape. The enclosure can have a wall thickness of at least about 0.053 inch (1.35 mm), although thinner or greater thicknesses could be used alternatively, for example, based on the metal chosen or for other applications. In one embodiment, the outside surface of the enclosure (e.g., metal portion) is marked with rating information, such as voltage and current rating information, make and manufacturer.

The fuse element can be rated for example for up to ninety-six VDC and one-thousand amps. It is contemplated however to configure the fuse element for higher voltage and amperage ratings if the industry has such a need. The fuse element can be serpentine, thinned or otherwise non-linear. The element in one embodiment is made of a copper alloy and may be formed integrally with or attached to at least one of the first and second terminals, which can be of the same or different material, such as copper alloy, zinc alloy, silver or silver plating.

In one embodiment, the fuse includes an insulating housing placed around the fuse element and inside of the enclosure. The insulating housing can be ceramic and fixed to the element or terminals. The insulating housing in one embodiment includes a window allowing a service person to see if the element has opened. The housing and window are in essence a leftover from the prior art which used a large metal enclosure having a removable lid and therefore may not be needed in the present application.

In one embodiment, the fuse includes an opened-fuse indicator positioned to inform a person that the fuse element has opened. The indicator can be a light emitting diode ("LED") placed in parallel with the element. Normally, not enough current flows through the LED to energize it. Upon an opening of the element, energy is shunted through the LED, energizing it an causing the LED to become illuminated, informing the service person of same. The LED is placed on one of the end caps in one embodiment.

In an alternative embodiment, a fuse bank is provided, which includes a plurality of fuse element assemblies. The enclosure here is sized to hold the plurality of fuse element assemblies. The enclosure again includes a metal body and insulating, e.g., plastic end caps. The plastic end caps each include a plurality of slits. Each slit accepts one of the terminals extending from one of the fuse elements. The fuse elements can be attached to the end caps mechanically and individually via stakes or bends in the terminals as shown below. The end caps in one embodiment each include an outer portion that mates flush with an outer surface of the enclosure and an inner portion that fits inside the enclosure.

The fuses of the fuse bank can again have intermediate insulating, e.g., ceramic, housings that surround each fuse element. The terminals extend from the fuse elements and from the insulating housings. The housings are positioned inside the bank enclosure and include viewing windows that allow an operator to view whether the fuse element has opened or not.

The fuse bank embodiment can also employ opened-fuse indication, e.g., LED's, described above. It is contemplated to provide a separate LED for each fuse element of the fuse bank. For example, the LED's can be placed adjacent to an associated fuse terminal on one of the end caps.

The different fuse elements can be rated for the same voltage and amperage or different voltages and amperages. The enclosure in one embodiment is at least substantially rectangular in cross-section, aluminum, steel or stainless steel, can have a wall thickness of at least about 0.053 inch (1.35 mm) and be provided with rating information for each fuse.

It is accordingly an advantage of the present disclosure to provide an improved fuse for a moderately hazardous environment.

It is another advantage of the present disclosure to provide a fuse system for a moderately hazardous environment, which is easier to diagnose when one or more of the fuses of the system opens.

It is a further advantage of the present disclosure to provide a fuse for a moderately hazardous environment, which can include open-fuse indication.

Additional features and advantages are described herein, and will be apparent from, the following Detailed Description and the figures.

DETAILED DESCRIPTION

Figure 1A:
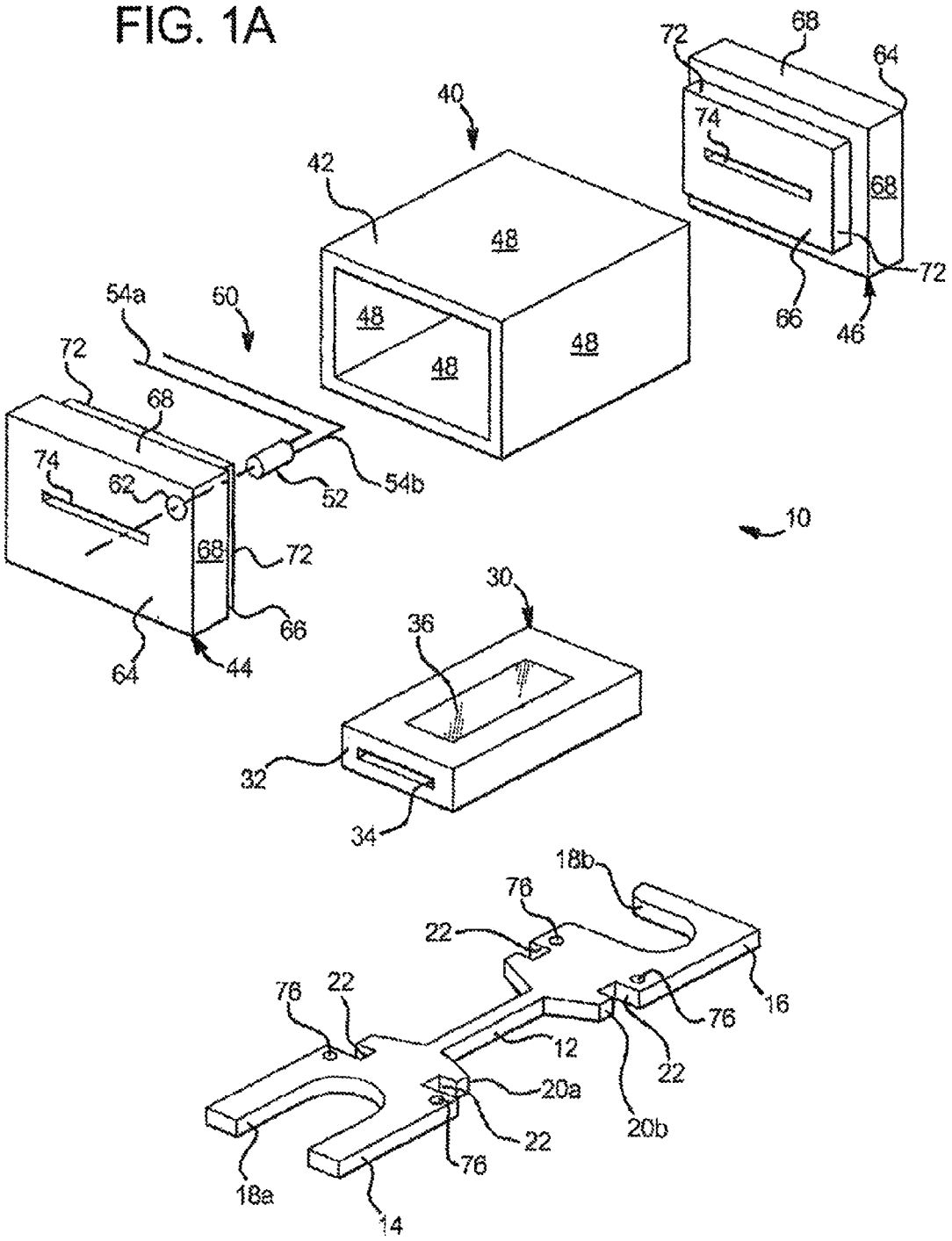
FIG. 1A is an exploded view of one embodiment of a moderately hazardous environment fuse of the present disclosure.
Figure 1B:
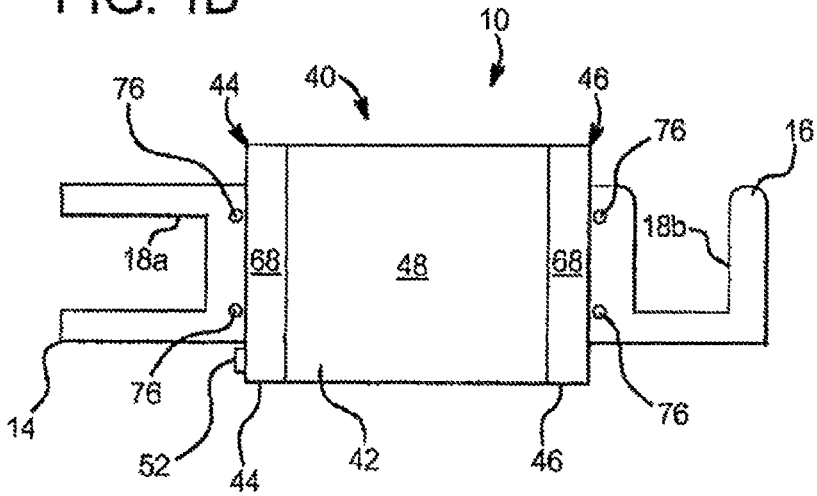
FIGS. 1B to 1D are top, front and perspective views, respectively, of the moderately hazardous environment fuse of FIG. 1A as assembled.

Referring now to the drawings and in particular to FIGS. 1 to 4, fuse 10 illustrates one embodiment of a moderately hazardous environment fuse of the present disclosure. As discussed above, one application for fuse 10 is in a fork lift, which falls under UL 583 EE and ES classifications. It should be appreciated however that fuse 10 can be used in other applications, including other moderately hazardous environment applications such as with vehicles operating with flammable products.

Fuse 10 includes a fuse element 12, which is sized to open at rated current and $i^2R$ values. For example, fuse 10 can be rated for operation anywhere up to ninety-six VDC and one -thousand amps. In any of the embodiments described herein an arc-quenching material such as sand or a larger grain material can, be added to the fuse, e.g., within the protective enclosure described below, to boost the fuses ratings. Again, fuse element 12 can be made for larger voltages and amperages if needed.

Fuse element 12 can be thinned (e.g., in one or two dimensions relative to terminals 14 and 16), serpentine in shape or otherwise non-linear in shape. Element 12 in one embodiment is made of a silver, copper, copper alloy or zinc alloy and can be formed integrally with or be attached to at least one of the first and second terminals 14 and 16. Element 12 can be fast acting (e.g., according to a CNN designation used by the eventual assignee of the present disclosure) or have a time delay before opening (e.g., according to a CNL designation used by the eventual assignee of the present disclosure).

Element 12 can be made of a base metal, such as copper or copper alloy, which is skived and inlaid with other desirable metals listed above. Terminals 14 and 16 may be made of one or more of copper, copper alloy, zinc or silver. Terminals 14 and 16 can be made of the same or different metal(s) as element 12 and accordingly be formed integrally with or attached to element 12. Tin or other low melting temperature metal spot can be placed at the position on the element at which it is desired for element 12 to open. The tin melts and diffuses into element 12 increasing resistance and causing element 12 to open more quickly.

Element 12 in an embodiment is about 0.020 to 0.080 inch (0.51 to 2.03 mm) thick by 0.060 to 0.260 inch (1.52 to 6.6 mm) wide by about 1.00 inch (2.54 cm) long. Terminals 14 and 16 in an embodiment are sized to receive a ¼ to 5/16 inch (6 to 8 mm) diameter bolt. In addition to changing the fuse element characteristics by varying width and thickness, bridges can be formed in element 12 for example by punching or otherwise providing one or more opening in the element at the position on the element at which it is desired for element 12 to open.

Terminals 14 and 16 each include a connecting slot 18*a* and 18*b*, which receives a mounting screw for holding fuse 12 firmly in place. In the illustrated embodiment, connecting slots 18*a* and 18*b* are oriented in different directions to enable fuse 12 to be inserted and removed readily. Alternatively, connecting slots 18*a* and 18*b* are oriented in a same direction, e.g., both opening to the sides of terminals 14 and 16 to provide for a side load/removal.

In the illustrated embodiment, housing restraining tabs 20*a* and 20*b* are located between terminals 14 and 16 and fuse element 12. Tabs 20*a* and 20*b* and terminals 14 and 16 form locking grooves 22 that each lock around an end wall 32 of an insulating housing 30. End walls 32 each define a slit 34, which is sized to allow one of the locking grooves 22, but not a corresponding locking tab 20*a* or 20*b*, to fit through the slit 34. In this manner, locking tabs 20*a* and 20*b* restrain fuse element 12 within insulating housing 30.

Insulating housing 30 provides a first layer of protection around fuse element 12 in the event that element 12 opens. Housing 30 can be a ceramic material, plastic material or other suitable insulating material. Housing 30 supports a viewing window 36. As mentioned above, housing 30 may not be required.

To operate in a moderately hazardous environment, an enclosure 40 is placed around housing 30 and fuse element 12. It should be appreciated that while housing 30 is shown with fuse 10, it is contemplated to provide fuse 10 without housing 30.

Enclosure 40 includes a metal portion 42 and end caps 44 and 46. Metal portion 42 in the illustrated embodiment includes walls 48, which can form the generally rectangular shape as illustrated or form a square shape. Alternatively, metal portion 42 forms an elliptical or round shape. The thickness of walls 48 in an embodiment is at least about 0.053 inch (1.35 mm), although thinner or greater thicknesses could be used alternatively, for example, based on the metal chosen or for other applications. Metal portion 42 can for example be made of aluminum, steel or stainless steel.

In the illustrated embodiment, metal enclosure 42 displays indicia or information, such as rating, company name and/or brand indicia or information. The indicia is for example laser etched onto or into metal portion. Alternatively, the information is printed onto metal portion 42. Further alternatively, a separate label is provided. Still further alternatively, space permitting, some or all of the indicia or information is provided on one or both end caps 44 and/or 46.

Metal enclosure 42 in one embodiment is anodized. The anodized surface provides an aesthetic finish and adds an extra insulating barrier because the anodized surface is nonconductive. The anodized surface provides an extra insulating barrier in the unlikely event that a molten fuse element 12 bridges to the inside of metal enclosure 42.

End caps 44 and 46 of enclosure 40 are made of an electrically insulating material so that they can contact conductive terminals 14 and 16, respectively, in communication with fuse element 12. End caps 44 and 46 in one embodiment are made of a relatively high melting temperature plastic material, such as Rynite™, Ryton™ or other thermoset plastic or thermoform plastic having a melting temperature of at least about 180° C. End caps can alternatively be made of another suitable insulator, such as ceramic or rubber.

An open-fuse indicator system 50 illustrates one embodiment for providing open-fuse indication to an operator or service person attempting to diagnose the status of fuse 10. Open-fuse indicating system 50 includes a low voltage bulb 52 powered via leads 54*a* and 54*b*. The operation of low voltage bulb 52 is independent of polarity so the operator can replace fuse 10 in either direction. In an alternative embodiment, open-fuse indicator system 50 includes a full wave rectifier (not illustrated) allowing a light emitting diode ("LED") to be used instead of a bulb.

Leads 54*a* and 54*b* are connected in parallel to opposite sides of fuse element 12. Under normal operation, when element 12 is conducting current, resister 56 does not allow enough energy to pass through bulb to illuminate the LED. When element 12 opens and stops conducting current, enough current passes through resister 56 to illuminate bulb 52. In this manner, the operator can see which fuse 10 has opened after removing a panel of the, e.g., fork lift, and without having to look fuse-by-fuse until finding the opened fuse.

In the illustrated embodiment, end cap 44 defines an aperture 62 for receiving lamp 52 of open-fuse indicating system 50. Lamp 52 can be placed on either or both end caps 44 and 46. In an alternative embodiment, open-fuse indication may not be provided. For higher voltage applications, an arc-quenching material such as sand can be filled into fuse 10 through hole 62. Lamp 52 or a plug if no indication is used is then fitted into hole 62 to prevent loss of the sand.

End caps 44 and 46 each include an outer portion 64 and an inner portion 66. Outer portion 64 includes sidewalls 68 that mate flush with walls 48 of metal portion 42 in the illustrated embodiment. Inner portion 66 includes sidewalls 72 that fit snugly within or press -fit to the inner surfaces of walls 48 of metal portion 42.

Figure 2A:
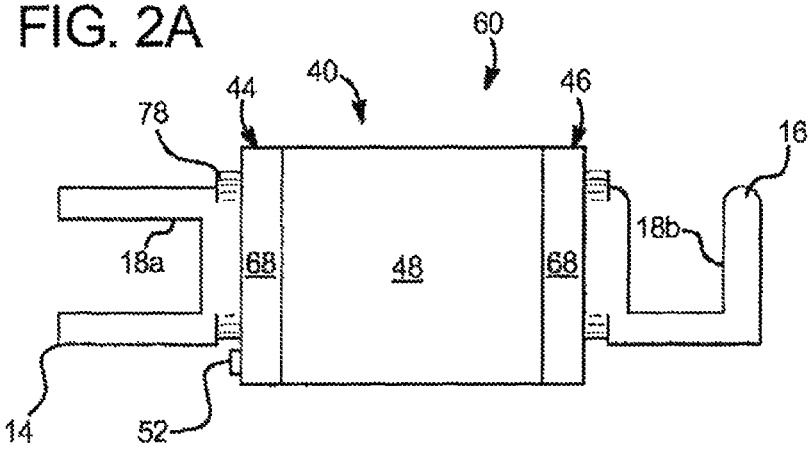
FIGS. 2A to 2C are top, front and perspective views, respectively, of an alternative moderately hazardous environment fuse of the present disclosure.
Figure 2B:
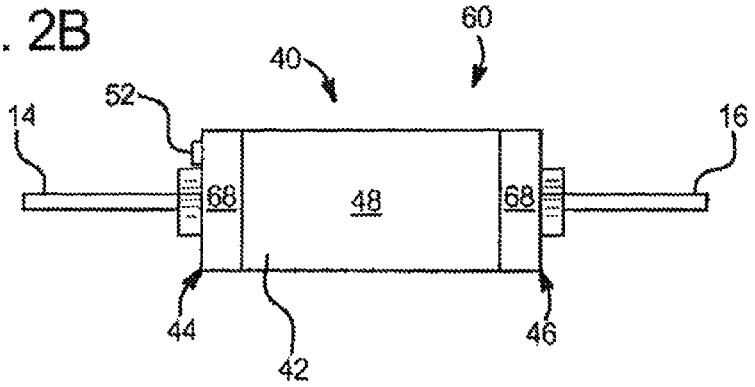
Figure 2C:
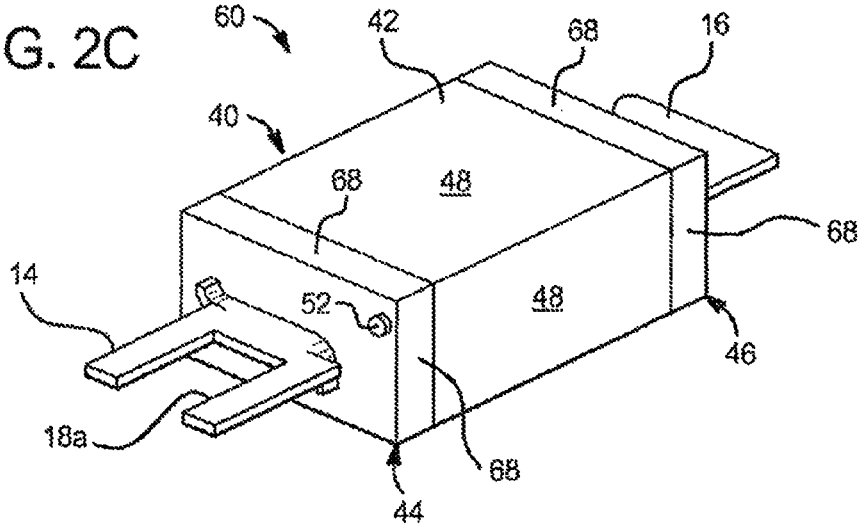

End caps 44 and 46 each include a slit 74, which extends through both outer portion 64 and inner portion of 66 of the end walls. Slits 74 are sized to let terminals 14 and 16 connected to (e.g., extending integrally from or attached to) element 12 to extend outside of end caps 44 and 46 of enclosure 40 when fuse 10 is assembled as seen in FIGS. 2A to 2C. Slits 74 are sized to be slightly wider and thicker than terminals 14 and 16, so that end caps 44 and 46 can be slid over the terminals without too much difficulty, but so that a minimum amount of open space resides between the edges of the slits 74 and the outer surfaces of terminals 14 and 16 to reduce the chance of a spark from an opened element 12 from leaving enclosure 40.

Figure 1C:
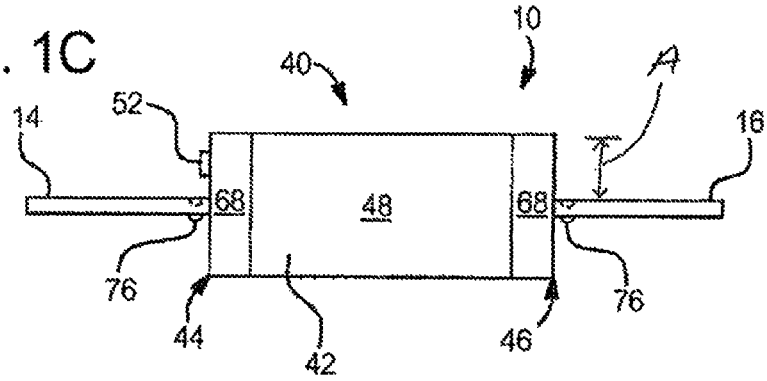
Figure 1D:
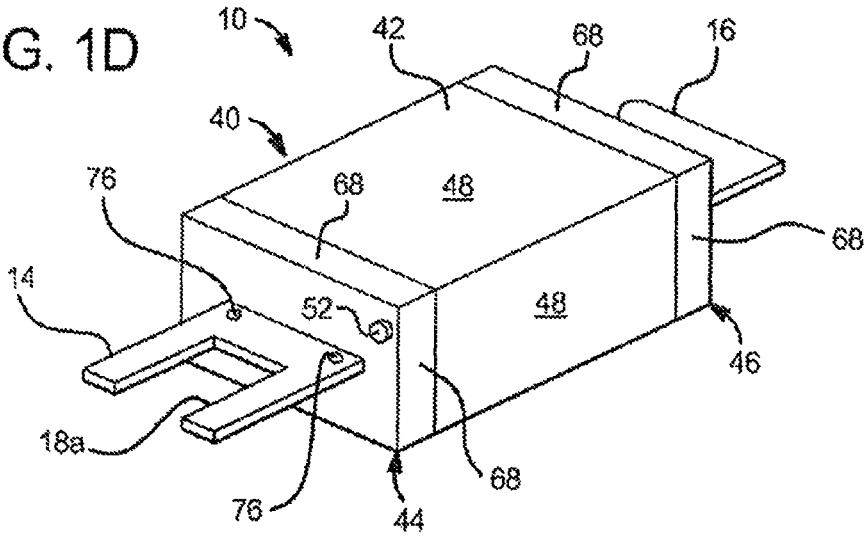

As shown in FIG. 1C, fuse element 12 is spaced from the inner surfaces of metal enclosure 42. In particular, fuse element 12 is spaced from the inner surfaces of walls 48 of metal enclosure 42 a predetermined distance A being at least 0.25" (6.35 mm). As mentioned earlier, housing 30 may not be employed within enclosure 40 in which case air may be disposed between fuse element 12 and the inner surfaces of walls 48. In this configuration, fuse element 12 is retained in position within metal enclosure 42 via positioning through slits 74 of respective end caps 44 and 46 whereby distance A is maintained. Alternatively, this space may be filled with ceramic beads and/or sand having a specified grain size to provide increased arc suppression at higher voltage levels. For example, a 40 volt fuse design may only require air to fill the space between fuse element 12 and the inner surfaces of walls 48. However, for a 90 volt fuse design, ceramic beads or sand may be required to provide sufficient arc suppression as well as providing heat dissipation characteristics. When housing 30 is employed around fuse element 12 within enclosure 40, housing 30 is configured such that the distance between fuse element 12 and the inner surfaces of walls 48 is maintained. In addition, housing 30 may contact the inner surfaces of walls 48 and/or housing 30 may be at least partially in contact with the inner surfaces of walls 48.

Fuse 10 of FIGS. 1A to 1D shows one embodiment for holding fuse element 12 and terminals 14 and 16 firmly within enclosure 40. Here, stakes or bumps 76 are formed in terminals 14 and 16 just outside of end caps 44 and 46. Stakes 76 can be stamped or punched into metal terminals 14 and 16, e.g., via a cold-staking process in one embodiment.

Stakes or bumps 76 prevent enclosure 40 from traversing in either direction over terminals 14 and 16. The stakes also provide a sturdy, mechanical attachment of end caps 44 and 46 to metal body 42, which should prevent the resulting enclosure 40 from rupturing or coming free from the terminals upon an opening of fuse element 12 if for example housing 30 is not provided.

Stakes or bumps 76 are shown extending downwardly in FIGS. 1A to 1D but could alternatively extend upwardly or in alternating directions. Two stakes per side are illustrated but more than two stakes 76 per side could be provided. Further alternatively, one or more elongated stake could be provided.

Referring now to FIGS. 2A to 2C, fuse 60 illustrates an alternative moderately hazardous environment fuse of the present disclosure. Fuse 60 includes many of the same components (including alternative embodiments thereof) as shown and described for fuse 10. Those components are numbered the same.

The primary difference between fuse 60 and fuse 10 is that stakes or bumps 76 of fuse 10 are replaced with bends 78 formed in terminals 14 and 16 of fuse 60. Bends 78 in the illustrated embodiment are made on two sides of terminals 14 and 16, adjacent to end caps 44 and 46. Bends 78 also attach end caps 44 and 46 to body 42 to form enclosure 40 in a firm and mechanical manner. Bends 78 are shown being bent in alternating directions, providing stability, but could alternatively be bent in the same direction.

Figure 3A:
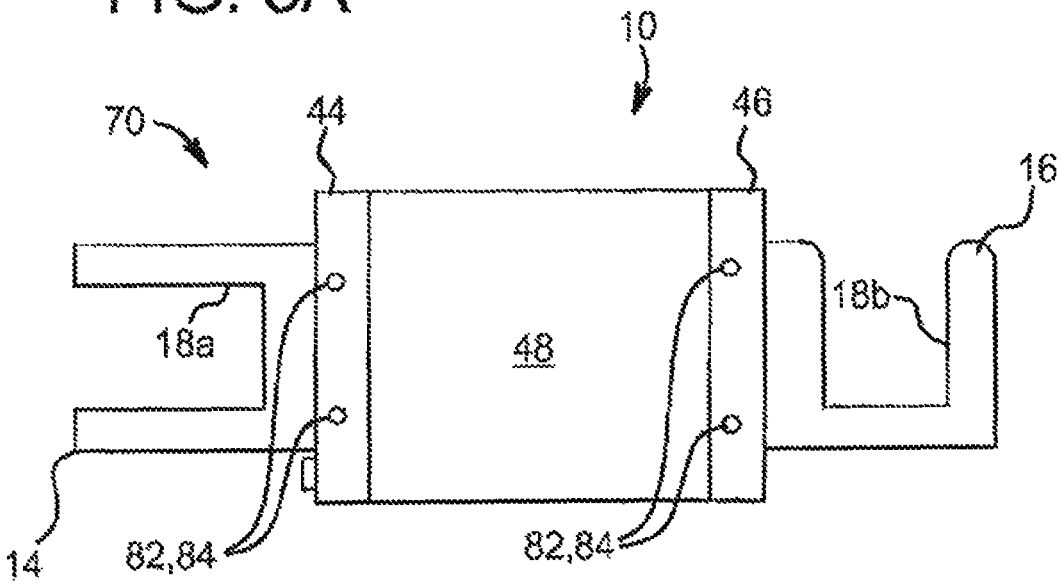
FIGS. 3A and 3B are top, front and perspective views, respectively, of an alternative moderately hazardous environment fuse of the present disclosure.
Figure 3B:
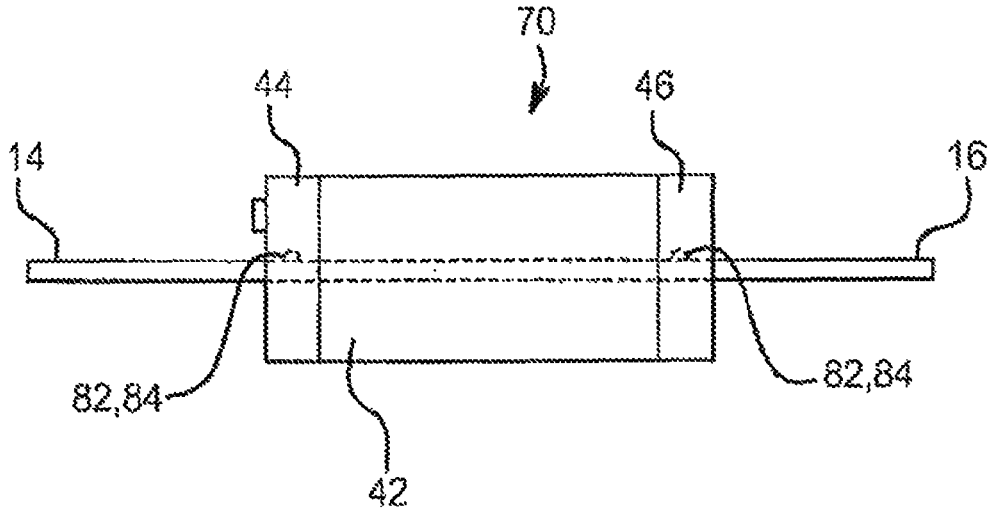

Referring now to FIGS. 3A and 3B, fuse 70 illustrates a further alternative moderately hazardous environment fuse of the present disclosure. Fuse 70 includes many of the same components (including alternative embodiments thereof) as shown and described for fuse 10. Those components are numbered the same.

The primary difference between fuse 70 and fuse 10 is that stakes or bumps 76 of fuse 10 are replaced with inner snap-fitting protrusions 82, which snap-fit into mating recesses 84 formed in end caps 44 and 46. Protrusions 82 can be rounded as illustrated. In an alternative embodiment, end cap recesses 84 are not performed but are formed instead by pressing end caps 44 and 46 into terminals 14 and 16, respectively. Here, protrusions 82 can be pointed.

The attachment mechanism of fuse 70 is advantageous in one respect because the attachment of enclosure 40 to terminals 14 and 16 occurs upon the coupling of end caps 44 and 46 to body 42, in essence saving a manufacturing step of stamping or bending discussed above with fuses 10 and 60, respectively. The attachment mechanism of fuse 70 may, however, not be as strong mechanically as those of fuses 10 and 60.

In one preferred embodiment, terminals 14 and 16 are coined or otherwise thickened just outside of end caps 44 and 46, respectively. The thickened sections hold end caps 44 and 46 against enclosure 40 and to the extent that they run the length of slits 74, seal the slits.

In any of the embodiments described herein, the end caps 44 and 46 are additionally or alternatively adhered to metal body 42. A non-flammable adhesive or epoxy can be suitable for this application.

Figure 4:
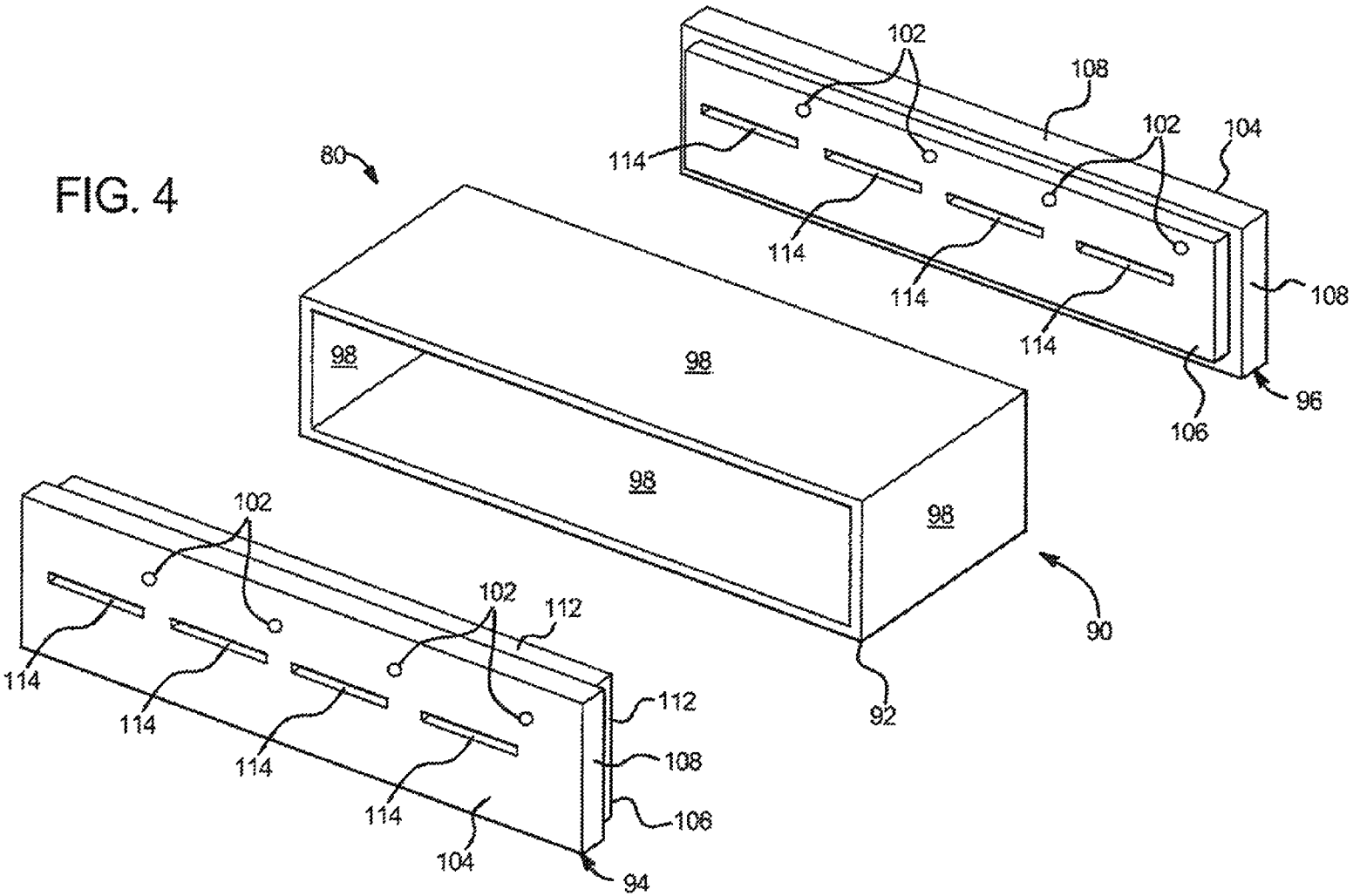
FIG. 4 is a perspective view of a moderately hazardous environment fuse bank of the present disclosure.

Referring now to FIG. 4, fuse bank 80 illustrates a further alternative moderately hazardous environment fuse arrangement of the present disclosure. Fuse bank 80 holds a plurality of fuse element/terminal/housing assemblies described above. For ease of illustration, those assemblies are not shown here. Fuses made according to any of the attachment mechanisms described above for attaching the fuse element assemblies to the enclosure 90 can be placed in fuse bank 80. As illustrated by the rating indicia on metal body 92 of bank 80, bank 80 can house fuses having the same or different ratings. All of the alternate embodiments discussed above for the indicia, e.g., the application of the indicia, are applicable with block 80.

To operate in a moderately hazardous environment, an enclosure 90 is placed around the fuses of bank 80. Enclosure 90 includes a metal body 92 and end caps 94 and 96. Metal portion 92 in the illustrated embodiment includes walls 98, which can form the generally rectangular shape as illustrated. The thickness of walls 98 in an embodiment is at least about 0.053 inch (1.35 mm), although thinner or greater thicknesses could be used alternatively, for example, based on the metal chosen or for other applications. Metal portion 92 can for example be made of any of the materials discussed above for metal portion 42.

End caps 94 and 96 of housing are made of an electrically insulating material so that they can contact conductive terminals 14 and 16, respectively, in communication with fuse element 12. End caps 44 and 46 in one embodiment are made of any of the materials discussed above for end caps 44 and 46.

End caps 94 and 96 each include an outer portion 104 and an inner portion 106. Outer portion 104 includes sidewalls 108 that mate flush with walls 98 of metal portion 92 in the illustrated embodiment. Inner portion 106 includes sidewalls 112 that fit snugly within or press -fit to the inner surfaces of walls 98 of metal portion 92.

End caps 94 and 96 each include a plurality of slits 114, one for each fuse, which extend through both outer portion 104 and inner portion of 106 of the end caps. Slits 114 are sized to let terminals 14 and 16 connected to (e.g., extending integrally from or attached to) elements 12 to extend outside of end caps 94 and 96 of enclosure 90 when the fuses are assembled into bank 80. Slits 114 are sized to be slightly wider and thicker than terminals 14 and 16, so that end caps 94 and 96 can be slid over terminals 14 and 16, respectively, without too much difficulty, but so that a minimum amount of open space resides between the edges of the slits 114 and the outer surfaces of terminals 14 and 16.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A fuse for a moderately hazardous environment comprising:

a fuse element;

first and second terminals connected to the fuse element, each of the first and second terminals having one or more snap-fitting protrusions;

a metal enclosure defined by a plurality of walls, each of said walls having an inner surface, said enclosure placed around the fuse element such that the first and second terminals extend from the metal enclosure, the enclosure configured to protect the environment from an opening of the fuse element wherein said fuse element being disposed within said metal enclosure defining a space between the inner surfaces of each of said walls and said fuse element;

a first end cap having a first slit, said first end cap connected to the metal enclosure such that the first terminal extends through said first slit of said first end cap, the first end cap having one or more recesses configured to receive the one or more snap-fitting protrusions on the first terminal; and a second end cap having a second slit, said second end cap connected to the metal enclosure such that the second terminal extends through said second slit of said second end cap, the second end cap having one or more recesses configured to receive the one or more snap-fitting protrusions on the second terminal.

2. The fuse of claim 1 wherein said space defines a predetermined minimum distance between said fuse element and said inner surface of said enclosure walls.

3. The fuse of claim 2 wherein said first and second end caps are configured to retain said fuse element within said enclosure said predetermined minimum distance from said inner surface of said walls.

4. The fuse of claim 1 wherein said space is filled with air.

5. The fuse of claim 1 wherein the end caps are plastic, ceramic or rubber.

6. The fuse of claim 1 wherein the first and second end caps each have an outer portion configured to mate flush with an outer surface of the enclosure and an inner portion configured to fit inside the enclosure.

7. The fuse of claim 1 wherein the predetermined distance is at least 0.25 inches.

8. The fuse of claim 2 further comprising an insulating housing placed around the fuse element and at least partially filing the space within said enclosure, said housing configured to maintain said predetermined distance between said fuse element and the inner surfaces of said enclosure walls.

9. The fuse of claim 8, wherein the insulating housing is made of a ceramic material.

10. The fuse of claim 1, wherein the one or more snap-fitting protrusions are rounded.

11. The fuse of claim 1, wherein, each of the one or more recesses in each of the first and second end caps are formed by pressing the first and second end caps into the first and second terminals.

12. The fuse of claim 11, wherein the one or more snap-fitting protrusions are pointed.

13. The fuse of claim 1, further comprising an open-fuse indicator system, the open-fuse indicator system comprising:

a bulb; and a resistor electrically connected in series with the bulb, the bulb and the resistor electrically connected in parallel with the fuse element.

14. The fuse of claim 1, wherein the bulb is disposed in an aperture located in either the first and second end cap.

15. The fuse of claim 1, wherein the bulb is a first bulb, the open-fuse indicator system further including a second bulb electrically connected in parallel with the fuse element.

16. the fuse of claim 15, wherein the first bulb is disposed in an aperture located in the first end cap and the second bulb is disposed in an aperture located in the second end cap.

17. The fuse of claim 1, wherein the bulb is an LED.

18. The fuse of claim 17, the open-fuse indicator system further including a full wave rectifier electrically connected to the bulb.

* * * * *